United States Patent [19]

Devan et al.

[11] 4,369,413

[45] Jan. 18, 1983

[54] INTEGRATED DUAL TAPER WAVEGUIDE EXPANSION JOINT

[75] Inventors: Joseph M. Devan; Hugh Milligan, both of San Diego, Calif.

[73] Assignee: The United States of America as represented by the Secretary of the Navy, Washington, D.C.

[21] Appl. No.: 230,995

[22] Filed: Feb. 3, 1981

[51] Int. Cl.[3] ..... H01P 1/06; H01P 5/02

[52] U.S. Cl. ..... 333/34; 333/251; 333/257

[58] Field of Search ..... 333/34, 254, 256, 257, 333/248, 251

[56] References Cited

U.S. PATENT DOCUMENTS

| | | | |
|---|---|---|---|
| 2,632,804 | 3/1953 | Jouguet | 333/248 X |
| 2,656,515 | 10/1953 | Hansen et al. | 333/248 X |
| 3,050,701 | 8/1962 | Tang | 333/34 |
| 3,822,412 | 7/1974 | Carlin et al. | 333/98 R |
| 4,247,838 | 1/1981 | Sirel | 333/257 X |
| 4,283,727 | 8/1981 | Martel et al. | 333/257 X |

*Primary Examiner*—Paul L. Gensler

*Attorney, Agent, or Firm*—Robert F. Beers; Ervin F. Johnston; Harvey Fendelman

[57] ABSTRACT

A $TE_{01}$ circular mode waveguide expansion joint, tapered transition device in which the expansion joint includes a linear tapered section, the greatest diameter of which does not exceed the cutoff diameter for the $TE_{02}$ spurious mode. A second taper of the cosine or other suitable type minimizes $TE_{02}$ mode generation as the guide diameter increases past the $TE_{02}$ cutoff value. The expansion, transition device simultaneously performs the functions of expansion section and waveguide diameter transition for the $TE_{01}$ circular mode while minimizing spurious mode generation.

9 Claims, 2 Drawing Figures

INTEGRATED DUAL TAPER WAVEGUIDE EXPANSION JOINT

BACKGROUND OF THE INVENTION

The present invention relates generally to the field of waveguides and more specifically to expansion joints for joining sections of waveguide.

Various tapers have been developed for the $TE_{01}$ circular waveguide mode. Expansion sections have also been used in $TE_{01}$ mode transmission lines. The expansion sections previously developed require the inside diameter of the expansion section to be tapered to a smaller size for the sliding expansion section and then tapered back to the required guide size. This is the standard procedure using linear tapers. Tapering to a larger diameter requires tapers of a more complex design to minimize generation of the $TE_{02}$ circular guide mode. Since larger diameter guide has lower loss, it is desirable for long straight sections. Expansion sections are also often required for long rigid lines. Using two separate components for expansion joints and tapers requires a total of three tapered diameters, four connectors and a length of guide which may be excessive.

SUMMARY OF THE INVENTION

The present invention relates to a device for simultaneously providing a mechanical expansion capability and taper transition between different operating waveguide diameters while minimizing the generation of unwanted modes, especially the $TE_{02}$ mode. This is accomplished by providing a first waveguide section which increases in diameter linearly from the diameter of the waveguide to which it is to be connected to a diameter that is sufficiently small to prevent the generation of spurious modes, especially the $TE_{02}$ mode. A second waveguide section is concentrically fitted in slideable engagement with the first waveguide section. The first and second waveguide sections are arranged to permit sliding of the sections with respect to each other to provide the expansion, contraction capability of the present invention. As will be disclosed, spring bias may also be provided for biasing the sections into either the expanded or the contracted position.

The second waveguide section has at one end thereof an internal diameter which is equal to the enlarged diameter of the first waveguide section. At the other end of the second waveguide section there is a cosine or other specially shaped section to enlarge the joint to the diameter of the other waveguide to which it is to be connected.

By limiting the increase in diameter of the first waveguide section of the expansion joint of the present invention to a diameter less than the cutoff diameter for the $TE_{02}$ spurious mode, that mode is prevented from propagating in the expansion joint of the present invention. Further, by utilization of the cosine tapered section in the second section of the waveguide expansion joint of the present invention, spurious moding is minimized. Thus, the present invention provides an expansion joint and a waveguide taper transition which requires only two taper sections for both functions. Further, whereas the prior art required separate units to provide for both the expansion-contraction function and the tapering function, the present invention requires only one unit to perform both functions. Additionally, the total length of waveguide section required to be added to any given system by use of the present invention is reduced by 25–50% from prior art techniques.

OBJECTS OF THE INVENTION

Accordingly, it is the primary object of the present invention is to provide a waveguide expansion section that also serves the function of a tapered transition.

Another object of the present invention is to provide an expansion joint which minimizes spurious moding.

Another object of the present invention is to disclose an improved expansion joint that is relatively simple and easy to manufacture as well as to install.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 2:
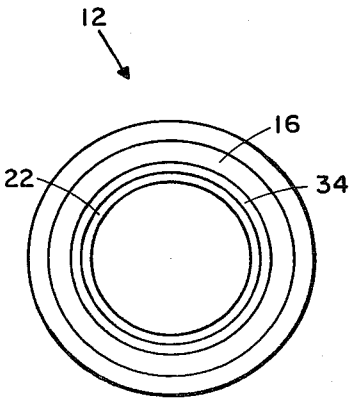
FIG. 2 is an end view of the expansion joint of the present invention.
Figure 1:
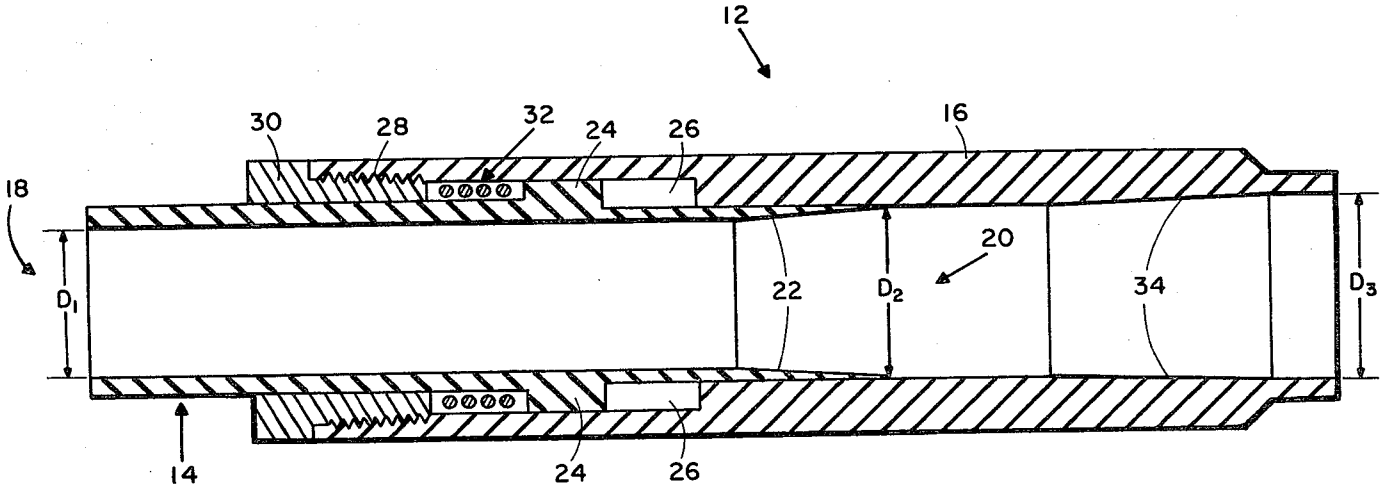
FIG. 1 is a longitudinal cross section of the expansion joint of the present invention.

Referring now to FIGS. 1 and 2 the expansion joint of the present will be described. The expansion joint 12 is comprised of a first waveguide section 14 that fits concentrically within and in slideable engagement with a second waveguide section 16. The waveguide section 14 includes a first end 18 for connection to another waveguide member (not shown). The second end 20 of the waveguide section 14 terminates within the section of waveguide 16. Further, a linear taper transition 22 increases the diameter $D_1$ of the waveguide section 14 at its end 18 to a larger diameter $D_2$ at the end 20 of the waveguide section 14. The diameter $D_2$ at the end 20 of the waveguide section 14 is suffiently large to match the inside diameter of the section of waveguide 16 at its left end, as illustrated in the drawing, but is sufficiently small to prevent the generation of undesired $TE_{02}$ modes of electromagnetic energy propagation. This is done by ensuring that the diameter $D_2$ of waveguide section 14 does not exceed the cutoff diameter for the $TE_{02}$ spurious mode. Between the ends 18 and 20 of the section of waveguide 14 an annular collar or flange 24 is provided in slideable engagement with the interior portion of waveguide section 16 and is located within the recessed area 26 formed within waveguide section 16.

Waveguide section 16 is provided with a threaded portion 28 for threaded engagement with the retaining nut 30 as illustrated. Recess area 26 is provided for permitting motion of and slideable engagement with the annular collar 24 of the waveguide section 14. Spring member 32 may be provided within the recess area 26 surrounding the section of waveguide 14 and in abutment with the retaining nut 30 and annular collar 24. Alternately, the spring member 32 could be eliminated or positioned on the other side of annular collar 24 for the opposite bias effect or springs could be used on both sides of collar 24 simultaneously. The interior diameter of waveguide section 16 in the area adjacent end 20 of the waveguide section 14 is identical to the diameter $D_2$. Traveling further down the waveguide, to the right in the illustration, the section of waveguide 16 is terminated in a cosine tapered section of waveguide 34. Although this section of tapered waveguide 34 increases the interior diameter of the section of waveguide 16 to the diameter $D_3$, which is a diameter large enough to support the $TE_{02}$ mode of electromagnetic energy propagation, the cosine taper has the effect of reducing $TE_{02}$ mode generation over that caused by a linear taper. Further, although a cosine taper section 34 has been illustrated and described it is within the scope of the present invention that other tapers may be used as is desired or required either to further reduce the $TE_{02}$ mode generation or by reason of a specific need in a particular application.

Waveguide sections 14 and 16 are precisely machined such that exterior surface of waveguide 14 is in slideable engagement with the interior surfaces of the section of waveguide 16 as in a piston-cylinder arrangement. As is apparent in the illustration the sliding section 14 may move within the recess 26 for either compression or expansion of the device 12. By reason of this sliding engagement between the members 14 and 16, the expansion joint 12 may be compressed for insertion of the device between rigid transmission line sections and also compensates for thermal expansion or contraction.

The expansion joint of the present invention is thus a practical $TE_{01}$ mode circular waveguide low loss transmission line component capable of simultaneously serving as a compression connector, expansion section and transition to a larger guide for long, low loss transmission lines such as would be used aboard ship between decks, bulkheads or up tall masts at millimeter wave frequencies.

Obviously, many other modifications and variations of the present invention are possible in the light of the above teachings. It is therefore to be understood that within the scope of the appended claims the invention may be practiced otherwise than as specifically described.

What is claimed is:

1. A tapered transition waveguide expansion joint for joining a first circular waveguide having a first diameter with a second circular waveguide having a second diameter for propagating electromagnetic energy in the $TE_{01}$ mode, said first diameter being less than said second diameter comprising:

a first section of circular waveguide having a first end, the inside diameter of said first end being equal to said first diameter, said first section of circular waveguide having a second end, the outside diameter of said second end having a third diameter greater than said first diameter and less than said second diameter, said third diameter being sufficiently small to prevent the generation of modes other than said $TE_{01}$ mode, said first section of waveguide including a section of linear taper waveguide between said first and second ends;

a second section of circular waveguide disposed such that it is concentric with said first section of circular waveguide over at least a portion thereof, said second section of circular waveguide being in slideable engagement with said first section of waveguide, said second section of waveguide having first and second ends, the inside diameter of said second section of waveguide first end being equal to said third diameter, and the inside diameter of said second section of waveguide second end being equal to said second diameter.

2. The expansion joint of claim 1 wherein said second section of waveguide includes a section of tapered waveguide.

3. The expansion joint of claim 2 wherein said section of tapered waveguide comprises a cosine tapered waveguide.

4. The expansion joint of claims 1, 2, or 3 wherein said first and second sections of waveguide comprise circular waveguides.

5. The expansion joint of claims 1, 2, or 3 wherein said modes other than said $TE_{01}$ mode include the $TE_{02}$ mode.

6. The expansion joint of claims 1, 2, or 3 further comprising:

a retaining nut in threaded engagement with said second section of waveguide and in slideable engagement with said first section of waveguide.

7. The expansion joint of claims 1, 2, or 3 further comprising:

spring means operatively engaged with said first and second sections of waveguide for biasing said first section of waveguide to a first position with respect to said second section of waveguide and for permitting movement of said first section of waveguide against said bias to a second position with respect to said first section of waveguide.

8. The expansion joint of claim 7 further comprising:

an annular collar connected to said first section of waveguide and in slideable engagement with said second section of waveguide.

9. The expansion joint of claim 8 wherein said second section of waveguide includes a recessed portion for receiving said annular collar in slideable engagement therewith.

* * * * *